United States Patent [19]

Kubbota et al.

[11] 4,410,619

[45] Oct. 18, 1983

[54] PHOTOGRAPHIC MATERIAL

[75] Inventors: Massashi Kubbota; Touru Noda, both of Toyko, Japan

[73] Assignee: Mitsubishi Paper Mills, Ltd., Tokyo, Japan

[21] Appl. No.: 366,690

[22] Filed: Apr. 8, 1982

[30] Foreign Application Priority Data

Apr. 11, 1981 [JP] Japan ..... 56-54849

[51] Int. Cl.[3] ..... G03C 1/86; G03C 1/06

[52] U.S. Cl. ..... 430/234; 430/531; 430/538; 430/566

[58] Field of Search ..... 430/531, 538, 566, 607, 430/231, 232, 234; 427/326

[56] References Cited

U.S. PATENT DOCUMENTS

| | | | |
|---|---|---|---|
| 3,332,776 | 7/1967 | Clark et al. | 430/607 |
| 3,466,173 | 9/1969 | Ishikawa et al. | 430/607 |
| 3,671,248 | 6/1972 | Eldridge et al. | 430/538 |
| 4,345,019 | 8/1972 | Kohmura | 430/566 |

*Primary Examiner*—Mary F. Downey

*Attorney, Agent, or Firm*—Cushman, Darby & Cushman

[57] ABSTRACT

In a photographic material, comprising a photographic constitution layer or layers containing a silver halide developer on a support obtained by coating base paper with a film-forming resin, the use of the base paper treated with a sulfinic acid or a salt thereof prevents the discoloration of the photographic material by the influence of the silver halide developer.

11 Claims, No Drawings

PHOTOGRAPHIC MATERIAL

This invention relates to a photographic material, and more particularly to a photographic material containing a silver halide developer in a photographic constitution layer or layers provided on the support obtained by coating base paper with a film-forming resin. [The photographic constitution layer or layers will hereinunder be noted photographic constitution layers unless singular is required.]

Generally, a photographic material is constituted of a support and photographic constitution layers provided thereon. The photographic constitution layers are silver halide photographic emulsion layer(s), protective layer, subbing layer, interlayers or color mixing preventing layers between the emulsion layers, antihalation layer, or filter layer, ultraviolet absorbing layer containing an ultraviolet light absorber, image receiving layer containing a physical developing nucleus for the diffusion transfer process or the like. In particular, A combination of photographic constitution layers at least one of which is a silver halide photographic emulsion layer is referred to as a silver halide photographic constitution layer(s), and a photographic material comprising silver halide photographic constitution layer(s) provided on support is referred to as a silver halide photographic material. For example, the single silver halide photographic material comprises silver halide photographic emulsion layer and protective layer provided thereon. The multilayer silver halide color photographic material comprises a blue-sensitive silver halide photographic emulsion layer and interlayer, green-sensitive silver halide photographic emulsion layer and ultraviolet absorbing layer, red-sensitive silver halide photographic emulsion layer and protective layer provided one after another adjacent to the support. In a specific photographic material, for example a photographic material for the diffusion transfer process in which a silver halide photographic material is used with an image receiving material in combination, as described in the Japanese Patent Kokoku (Post-Exam. Publn.) Nos. 11093/63, 27568/64 and 43778/76, the image receiving material has a support and, provided thereon, photographic constitution layers at least one of which is image receiving layer. Furthermore, it has been known to provide, if necessary, a coating layer consisting of a hydrophilic colloidal layer, which is called an antistatic and anticurl back coat layer, on the back side of the photographic material, i.e. the support surface on which the photographic constitution layer, mostly the silver halide photographic constitution layer is not provided. However, the coating layer is not included in the photographic constitution layer in the present invention.

Incidentally, in recent years, there has been increasingly great need for efficient photographic materials meeting the demands in photographic processing such as speed up and simplification of development processing of photographic materials or improvement in durability of photographic developers as well as demands in photographic characteristics such as acceleration of developability of silver halide photographic emulsion, and improvement in sensitivity, contrasting of gradation, sharpness or resolving power, and the like. As for photographic materials capable of meeting such demands, there has been the trend to more production of photographic materials comprising as a photographic support a resin-coated paper obtained by coating paper consisting essentially of natural pulp as base paper with a film-forming resin such as a polyolefin resin and provided thereon, photographic constitution layers at least one of which contains a silver halide developer. The reason is as follows: First, the silver halide developer contained in the photographic constitution layers of such photographic material permits more rapid and efficient developing effect from the initial development than the photographic material containing no silver halide developer. Second, the hydrophobic resin-coated paper as the photographic support provides more difficult permeation of the developer into the base paper layer during the development and fixing treatment of the photographic material than baryta paper which has hitherto been used as the photographic support, and therefore there have been obtained advantages of shortening the processing time such as water washing, drying and the like.

Serious disadvantages, however, have been found in the photographic material comprising silver halide developer contained in the photographic constitution layers provided on a resin-coated paper as a photographic support which is obtained by coating the paper consisting essentially of nutrual pulp as base paper with a film-forming resin. Thus, the photographic materials stored after the production thereof will turn yellow, yellowish brown or yellowish red with a longer period of storage. This phenomenon is particularly remarkable under high temperature and humidity conditions. The discoloration is clearly observed particularly when the photographic materials are seen from the side opposite to the photographic constitution layers. The investigation made on the discoloration phenomenon by the present inventors revealed the following facts: First, the discoloration occurs not only in the photographic constitution layers containing the silver halide developer but also in the base paper layer consisting essentially of natural pulp. Besides, the developing and fixing treatment of the photographic materials will not substantially reduce the discoloration. Second, the discoloration is not found in photographic constitution layers containing no silver halide developer. Third, the discoloration is not observed in the photographic material comprising photographic constitution layers containing silver halide developer provided on the so-called synthetic paper as a support. As described above, this discoloration is considered to be caused based on the mutual interaction between the resin-coated paper as a support comprising the base paper and a silver halide developer contained in the photographic constitution layers on the support. The definite mechanism is still unknown. The discoloration, however, will cause the staining of ground and image of the photographic material and deterioration in photographic characteristics, and degrade the product value thereof.

Thus, the object of the present invention is to provide a photographic material wherein the discoloration by the silver halide developer is prevented.

Another object of the present invention is to provide a photographic material having good operation or work efficiency in development.

A further object of the present invention is to provide an excellent photographic material having improved photographic characteristics and high whiteness.

As a result of intensive research, the present inventors have found that the objects of this invention are achieved by using, as a support, resin-coated paper obtained by coating a film-forming resin on base paper treated with at least one of compound expressed by the general formula [I]:

$$R—SO_2M \quad [I]$$

wherein R represents an alkyl, substituted alkyl, aryl or substituted aryl group; M represents a hydrogen atom, alkali metal atom, alkaline earth metal atom or ammonium.

In the photographic material of the present invention, it has been found that quite surprising effects are observed not only on the prevention of discoloration in the base paper of resin-coated paper as a support but also on the simultaneous prevention of discoloration in photographic constitution layers containing the silver halide developer.

Specific examples of the compounds expressed by the general formula [I] and used for carrying out the present invention include dodecylsulfinic acid or sodium salt thereof, benzenesulfinic acid or sodium salt thereof, p-toluenesulfinic acid or sodium or calcium salt thereof. Benzenesulfinic acid, p-toluene-sulfinic acid or salts thereof are particularly useful among the compounds expressed by the general formula [I] from the viewpoint of improved discoloration preventing effect and availability at a low cost. The sulfinic acid compounds used in the present invention, however, will not be limited thereto.

Treatment of base paper with the compounds expressed by the general formula [I] may be carried out by adding the compounds to a stock slurry in preparation thereof, but advantageously in the step of paper making such as size press, tub size or spray. Furthermore, the compounds may be applied to the base paper with an air knife coater, roll coater, gravure coater, blade coater or the like. The amount of the compounds expressed by the general formula [I] to be applied is not particularly limited, however, preferably 50–5000 mg per $m^2$ of the base paper. If the amount is less than 50 mg, the effect of the present invention is slight. If the amount is 50 mg or more, there is not particular limitation, but too much compounds added will not provide a clear impregnating solution due to the solubility, and the processability is markedly deteriorated. Therefore, the amount of 5000 mg or more to be added is undesirable.

The silver halide developer refers to compounds capable of developing silver halide by treating with an development activator, for example an alkaline solution, and includes silver halide developing agents and developing agent precursors. Specific examples of silver halide developing agents include hydroquinone compounds such as hydroquinone, 2-methylhydroquinone, 2,5-dimethylhydroquinone, trimethylhydroquinone, 2-chlorohydroquinone, 2-phenyl-hydroquinone, 2-tert-butylhydroquinone, 2,5-di-tert-butylhydroquinone, 2,5-di-tert-octylhydroquinone and the like; polyhydric phenol compounds such as catechol, 4-tert-butyl-catechol, pyrogallol and the like; 3-pyrazolidone compounds such as 1-phenyl-3-pyrazolidone (phenidone), 1-(m-tolyl)-3-pyrazolidone, 1-phenyl-2-acetyl-3-pyrazolidone, 1-phenyl-4-methyl-3-pyrazolidone, 1-phenyl-4,4-dimethyl-3-pyrazolidone, 1-phenyl-4-methyl-4-hydroxymethyl-3-pyrazolidone, 1-p-chlorophenyl-4-methyl-4-hydroxy-3-pyrazolidone, 1-(p-tolyl)-4,4-dihydroxymethyl-3-pyrazolidone, 1-phenyl-4-hydroxymethyl-3-pyrazolidone and the like; amino-phenol compounds such as p-amino-phenol, 2-amino-4-methyl-phenol, Metol®, 4-hydroxyphenylaminoacetic acid and the like; aminohexose reductone compounds such as dimethylaminohexose reductone, di-n-butylaminohexose reductone, morpholinohexose reductone, piperazinohexose reductone and the like; aminonaphthalenediol compounds such as 4-amino-1,4-dihydroxynaphthalene, 2-amino-1,5-dihydroxynaphthalene and the like; 4-aminoaniline compounds such as p-phenylenediamine, 4-(N,N-diethyl)aminoaniline, 4-(N-ethyl-N-hydroxyethyl)aminoaniline, 4-(N-ethyl-N-β-methylsulfonaminoethyl)amino-2-methylaniline and 4-(N-ethyl-N-hydroxyethyl)amino-2-methylaniline and hydrochlorides, sulfates and tetraphenylborates thereof and the like; hydrazine; hydroxyamine; naphthalenediol; and the like. Specific examples of the developing agent precursors include 4-chloroacetyloxyhydroquinone, hydroquinone monoacetate, 1,4-dichloroacetyloxyhydroquinone, 1,4-diacetyloxyhydroquinone, catechol monobenzoate, 2-methyl hydroquinone monoacetate, hydroquinone monobenzoate, 2-methoxy hydroquinone monobenzoate, and the like. However, the deveoopers or precursors thereof used will not be limited to those listed above. The silver halide developers may be used alone or in combination. For example, the use of a hydroquinone compound with a 3-pyrazolidone compound is useful.

Furthermore, the silver halide developer is contained in at least one photographic constitution layer provided on a support, said layers in which the silver halide developer may be contained being silver halide photographic emulsion layers, protective layer, subbing layer, interlayers or color mixing preventing layers, antihalation layer or filter layer, ultraviolet absorbing layer, and image receiving layer. However, it is particularly useful to contain the silver halide developer in silver halide photographic emulsion layers of the silver halide photographic materials. If necessary, the silver halide developer can be contained in the silver halide photographic emulsion layers and other photographic constitution layers than the silver halide photographic emulsion layers. In contrast, the silver halide developers may be contained only in other photographic constitution layers than the silver halide photographic emulsion layers. In contrast, the silver halide developers may be contained only in other photographic constitution layers than the silver halide photographic emulsion layers according to the uses, purposes thereof, and the like. Furthermore, in specific photographic materials, for example, those for the diffusion transfer process, 3-pyrazolidone compounds are contained in photographic constitution layers of silver halide photographic material, and separately hydroquinone compounds are contained in the photographic constitution layer of image-receiving layer. For incorporating the silver halide developer in photographic constutution layers, it is advantageous to add the silver halide developer to a hydrophilic colloidal coating mixture used for the photographic constitution layers in the preparation of the photographic material.

For adding the silver halide developer, the following methods are advantageous:

(1) the method wherein the silver halide developer is dissolved in solvents such as water, methanol, ethanol, propanol, isopropanol, acetone, methyl ethyl ketone, benzene, dioxane and the like, and the resulting solution is added to a coating mixture for the photographic constitution layers; (2) the oil protecting method wherein the silver halide developer is dissolved in high-boiling solvents such as dibutyl phthalate, di-n-nonyl phthalate, tricredylphosphate and the like or if necessary in mixed solvents of the high-boiling solvents with low boiling solvents such as ethyl acetate, cyclohexane and the like, and emulsified and dispersed in another hydrophilic colloidal solution in the presence of a surfactant, and the resulting emulsion is added to a coating mixture for the photographic constitution layers; (3) the resin latex method wherein the silver halide developer is dissolved in low-boiling solvents, occluded in a resin latex, and added to the coating mixture for photographic constitution layers; and the like. The amount of the silver halide developer to be incorporated in the photographic constitution layers actually depends on types of silver halide developers, types or uses of photographic materials, types (for example, composition, crystal habit, particle diameter, crystallographic form, and the like) of silver halides in silver halide emulsion layers, properties of emulsions such as silver ion concentration, pH, binders and the like, kinds of additives such as stabilizers for silver halide emulsions, fog restrainers, sensitizing dyes, hardening agents and the like. The amount will not be restricted particularly, but is usually 5 g/m$^2$ or less. Most preferably, the amount is 3 g/m$^2$ or less for the hydroquinone compounds and 1 g/m$^2$ or less for the 3-pyrazolidone compounds.

The photographic material of the present invention is used in silver halide black and white photographic materials, silver halide color photographic materials, multilayer silver halide color photographic materials, silver halide photographic materials and image receiving materials for the diffusion transfer process (for example, materials described in the Japanese Patent Kokoku (Post-Exam. Publn) Nos. 11093/63, 27568/64, 43778/76 and the like), direct positive silver halide photographic materials, general photographic papers, photo-composition photographic papers, copying photographic papers, block copy materials, printing materials (for example, including materials described in the Japanese Patent Kokoku (Post-Exam. Publn.) No. 30562/73) and the like. However, the use of the photographic material of the present invention will not be restricted thereto.

Base paper consists essentially of natural pulp. However paper prepared from a mixture of natural pulp with synthetic pulp or synthetic fiber other than natural pulp may be used. Wood pulp such as soft wood pulp, hard wood pulp, mixed soft wood and hard wood pulp treated by the ordinary bleaching with chlorine, hypochlorites, chlorine dioxide and the like as well as alkali extraction or alkali treatment and if necessary peroxide bleaching such as hydrogen peroxide, peracetic acid and the like may be advantageously used as the natural pulp. Various pulps such as kraft pulp, sulfite pulp, soda pulp or pulp prepared by using anthraquinone compounds as a digesting assistant may be used.

Various high polymers and additives may be incorporated in base paper essentially consisting of natural pulp by adding the polymers and additives to stock slurries in the preparation thereof. For example, it is advantageous to incorporate cationic starch, cationic polyacrylamide, anionic polyacrylamide, carboxy-modified polyvinyl alcohol, gelatin and the like as a dry strength agent; fatty acid salts, rosin, rosin derivatives such as maleinized rosin and the like, alkenyl- or alkylsuccinic acid, salts or anhydrides thereof, emulsified dialkylketene dimers, petroleum resin emulsions and the like as a sizing agent; clay, kaolin, calcium carbonate, barium sulfate, titanium dioxide, aluminum hydroxide, magnesium hydroxide and the like as a filler; melamine resin, urea resin, epoxidized polyamide resin and the like as a wet strength agent; multivalent metal salts such as aluminum sulfate, aluminum chloride and the like as a fixing agent; caustic soda, sodium carbonate and the like as a pH adjustor; dyes and fluorescent brightening agents; and the like in a suitable combination thereof. Paper machines such as Fourdrinier paper machine, cylinder paper machines and the like usually used are employed for making the base paper.

The base paper consisting essentially of natural pulp is advantageously sprayed or tub sized or size pressed with a solution containing various types of water-soluble high polymers and additives. It is advantageous to use cationic starch, polyvinyl alcohol, carboxy-modified polyvinyl alcohol, carboxymethyl cellulose, hydroxyethyl cellulose, cellulose sulfate, gelatin, casein, sodium polyacrylate, sodium salt of styrene-maleic anhydride copolymer, sodium polystyrenesulfonate and the like as the water-soluble high polymer; petroleum resin emulsions, ammonium salt of styrenemaleic anhydride copolymer alkyl ester, emulsified alkylketene dimers, latices and emulsions of styrenebutadiene copolymer, ethylene-vinyl acetate copolymer, polyethylene, vinylidene chloride copolymers and the like as a sizing agent; common salt, Glauber's salt and the like as an inorganic electrolyte; glycerol, polyethylene glycol and the like as a hygroscopic substance; clay, kaolin, talc, barium sulfate, titanium oxide and the like as a pigment; hydrochloric acid, phosphoric acid, caustic soda, sodium carbonate and the like as a pH adjustor; and additives such as dyes, fluorescent brightening agents and the like in combination.

The kind and thickness of base paper consisting essentially of natural pulp are not particularly limited; however, base paper having good surface smoothness prepared by compressing the formed paper with a calender is preferred. The basis weight is preferably 40 g/m$^2$–250 g/m$^2$.

Examples of the film-forming resin to be used for coating the base paper are homopolymers or copolymers including polyolefins; polystyrene; polyvinyl chloride; polyacrylic esters; linear polyesters such as polyethylene terephthalate; polycarbonates; polyamide such as nylon; cellulosic esters; polyacrylonitrile; ethylene-vinyl acetate copolymer and the like, and a mixture thereof. However, any resin applicable to the base paper will not be restricted thereto. Polyolefin resins are particularly advantageous from the viewpoint of extrusion coating performance, good adhesiveness to the base paper, price and the like. Examples of the polyolefin resins include olefin homopolymers such as low-density polyethylene, high-density polyethylene, polypropylene, polybutene, polypentene and the like; or copolymers obtained by polymerizing two or more olefinic monomers such as ethylene-propylene copolymers; and mixtures thereof. The resins having various densities and melt viscosity indexes (hereinafter referred to as simply MI) may be used alone or in a mixture thereof.

Various additives, for example white pigments such as titanium oxide, zinc oxide, talc, calcium carbonate and the like; fatty acid amides such as stearamide, arachidamide and the like; metal salts of fatty acids such as zinc stearate, calcium stearate, aluminum stearate, magnesium stearate, zirconium caprylate, sodium palmitate, calcium palmitate, sodium laurate and the like; antioxidants such as tetrakis-[methylene-3(3,5-di-tert-butyl-4-hydroxyphenyl)propionate] methane, 2,6-di-tert-butyl- 4-methylphenol and the like; pigments and dyes such as cobalt blue, Berline blue, ultramarine blue, cerulean blue, phthalocyanine blue and the like; Magenta pigments and dyes such as cobalt violet, Fast Violet, manganese violet and the like; fluorescent brightening agents such as bis(tert-butylbenzoxazole)thiophene, bis(methylbenxozole)-naphthalene and the like; ultraviolet light absorbers such as Tinuvin 320, Tinuvin 326, Tinuvin 328 (trade names, Ciba Geigy A.G.) and the like in a suitable combination may be preferably used in the film-forming resin. These additives are added to resins, preferably polyolefin resins, most suitably by the melt mixing methods with heated kneading rolls, Banbury mixer, kneader, kneading extruder and the like. Compounded mixtures containing all the respective components initially adjusted in a desired composition ratio may be used or masterbatches each containing the individual component in a high concentration may be prepared and mixed in a desired proportion for use.

The resin-coated paper is usually prepared by the so-called extrusion coating method wherein a hot-melt resin is extrusion coated on the running base paper, and preferably both sides of the base paper are coated with a resin. The base paper is preferably subjected to the activation treatment such as corona discharge treatment or flame treatment prior to the resin coating on the base paper. The emulsion side on the resin-coated paper has a glossy surface, matte surface or silk finish surface according to the uses thereof, and the back side is usually a dull surface. The right side, or if necessary both the right and the back sides may be subjected to the activation treatment such as corona discharge treatment or flame treatment. The thickness of the resin layer on the resin-coated paper is not particularly limited, but is advantageously about 5–50 microns.

Various silver halide photographic emulsion of the silver halide photographic constitution layers may be advantageously used. Examples of the particularly useful various emulsions include emulsions consisting of silver chloride, silver bromide, silver chlorobromide, silver chloroiodobromide, silver iodochloride, silver iodobromide and the like as a silver halide, or a mixture thereof; emulsions consisting of particles of regular shape such as cubic particles or emulsions consisting of particle groups of irregular shape having twin crystal structure or emulsions consisting of particles having crystal faces [1, 0, 0], [1, 1, 1] and the like or emulsions consisting of mixed crystal particles thereof such as emulsions consisting of mixed crystal particles having crystals faces [1, 0, 0] and [1, 1, 1] for the crystallographic form or crystal habit of the silver halide; fine particulate emulsions or coarse particulate emulsions or emulsions having a wide range of particle distribution or emulsions having a narrow range of particle distribution such as monodisperse emulsions and the like for the particle diameter or particle size distribution of silver halides; emulsions having a pH in the range of 4.0–8.0; emulsions having a silver ion concentration in the range of PAg 0.6–PAg 11.0; emulsions containing gelatin or synthetic hydrophilic binders such as polymers of polyvinyl alcohol, poly N-vinyl pyrrolidone, acrylic acid-acrylic esteracrylamide copolymers, and the like. Negative silver halide photographic emulsions may be used, or if necessary direct positive silver halide photographic emulsions may be used. Furthermore, either surface latent image type silver halide photographic emulsions (capable of forming latent images mainly on the silver halide particle surface) or internal latent image type silver halide photographic emulsions may be used if necessary.

Emulsions prepared by various methods and under diverse conditions of forming, dispersing and the first ripening of silver halide photographic emulsions may be used. For example, there may be employed emulsions prepared by mixing methods in regular order or reverse order, simultaneous mixing method (double jet or multi-jet method); converted silver halide method, ammonia method, acidic or neutral method, alkali method as described in the Japanese Patent Kokobu (Post-Exam. Publn.) No. 7772/71 and U.S. Pat. No. 2,592,520; and silver iodide nucleus method as described in the Japanese Patent Kokai (Laid-Open) No. 65925/73, and a combination thereof. Emulsions prepared by incorporating various additives in the silver halide photographic emulsions during the formation and dispersion thereof or during or after the first ripening may be used advantageously. For example, useful emulsions contain water-soluble rhodium compounds such as rhodium trichloride, hexahalogenorhodate and the like; water-soluble iridium compounds such as hexahalogenoiridium complex salts such as hexahalogenoiridate (III) salts, hexahalogenoiridate (IV) salts and the like and iridium (III) chloride, iridium (III) bromide and the like; water-soluble gold compounds such as gold halides, aurates, halogenoauric acids, halogenoaurates and the like; water-soluble platinum compounds such as tetrachloroplatinates; mercapto-heterocyclic compounds as described or exemplified in the Japanese Patent Kokai (Laid-Open) Nos. 149725/75 and 107129/76; hydroxyazaindolizine compounds as described in the Japanese Patent Kokai (Laid-Open) No. 103018/79, water-soluble inorganic and organic metallic salts of zinc, lithium, nickel and the like, and a suitable combination thereof. The silver halide photographic emulsions after the first ripening are preferably precipitated, dehydrated and washed with water until the desired electric conductivity and silver ion concentration are obtained. However, emulsions unwashed with water may be also used.

These silver halide photographic emulsions are usually used after subjected to the various chemical sensitizing treatments. Examples of useful emulsions subjected to the chemical sensitizing treatments include emulsions subjected to the sulfur sensitization with sensitized gelatin containing active sulfur compounds, thiosulfates or active sulfur compounds; emulsions subjected to the seleno sensitization with seleno compounds such as N,N-dimethylselenourea and the like; emulsions subjected to the noble metal sensitization with water-soluble compounds of noble metals such as iridium, gold, platinum and the like; emulsions sensitized with polyethylene oxide derivatives and the like. Emulsions further subjected to the spectral sensitization or super sensitization with polymethine sensitizing dyes such as cyanine, merocyanine, carbocyanine and the like alone or in a combination thereof or a combination thereof with styryl dyes may be advantageously used.

For carrying out the present invention, silver halide color photographic emulsions may be also used. Thus, emulsions containing compounds (couplers) capable of forming dyes on reaction with oxidation products of developing agents may also be used. Typical couplers usable for the object include pivaloylacetanilide or benzoylacetanilide type open chain ketomethylene yellow coupler, pyrazolone Magenta coupler, phenol or naphthol cyan coupler, and a mixture thereof or black couplers and the like. Examples of couplers include development inhibitor-releasing couplers (DIR couplers), two equivalent couplers wherein active sites are substituted by —O— aryl, —O— acyl, hydantoin compounds, urazole compounds, succinimide compounds, monooxoimide compounds, pyridazone compounds and the like.

Various substances may be used as binders or protective colloids in the photographic constitution layers. Thus, examples of the substances include gelatin treated with lime or acids; gelatin derivatives such as phthalyl gelatin and acylated gelatin; starch and derivatives thereof; cellulose compounds such as carboxymethyl cellulose, hydroxyethyl cellulose, and the like; synthetic hydrophilic binders such as polyvinyl alcohol, poly-N-vinylpyrrolidone, acrylic acid-acrylic ester copolymers, acrylic acid-acrylamide copolymers, acrylic acid-acrylic ester-acrylamide copolymers and the like. Examples of thickners for gelatin and derivatives thereof include natural or synthetic high polymers having hydroxyl groups such as cellulose, dextran, dextrin, alginic acid, starch, polyvinyl alcohol and the like, preferably sulfate compounds of polysaccharide, polymers such as styrene-maleic acid copolymer, alkyl vinyl ether-maleic acid copolymers and the like alone or in a combination.

Various antifoggants or stabilizers are advantageously contained in photographic constitution layers, particularly preferably silver halide photographic emulsion layers. Examples of the antifoggants or stabilizers include hydroxy-azaindolizine compounds as described in the U.S. Pat. Nos. 2,716,062 and 2,944,900; mercapto-heterocyclic compounds as described in the Japanese Patent Kokai (Laid-Open) Nos. 10262/73 and 107129/76; heterocyclic compounds such as 2-thione heterocyclic compounds, benzimidazole, benztriazole, 1-phenyl-tetrazole, benzoxazole, guanazole compounds and the like containing no mercapto group, and a combination thereof.

Various additives may be contained in the photographic constitution layers. Examples of the additives include organic hardening agents such as reaction products of formalin or formaldehyde with urea or melamine and the like, halogenocarboxylic acids, vinyl sulfone compounds, aziridine compounds, epoxy compounds, active halogen compounds, acryloyl compounds, isocyanate compounds and the like; inorganic hardening agents such as chrome alum, zirconium carbonate and the like, as hardening agents; anionic surfactants such as alkylbenzene sulfonates, sulfosuccinic ester salts, and the like, nononic surfactants such as saponin, alkylene oxide compounds and the like, amphoteric surfactants such as amino acids, aminosulfonic acids, esters of aminoalcohols and the like as surfactants; benztriazole compounds having a hydroxy-dialkyl-phenyl group at the 2-position and the like as ultraviolet light absorbers; compounds as described or exemplified in the Japanese Patent Kokoku (Post-Exam. Publn.) No. 24068/70 and Patent Kokai (Laid-Open) No. 94318/79 as fluorescent brightening agents; Food Red No. 2, acid dyes exemplified in the Japanese Patent Kokai (Laid-Open) No. 14721/72 and the like as sharpness improving dyes; ethylenediaminetetraacetic acid as sequestering agents; N-guanylhydrazone compounds, quaternary onium salt compounds and the like as mordants; cellulosic antistatic agents, alkali salts of polystyrenesulfonic acid, alkali salts of polyacrylic acid, acrylic acid copolymers and the like as antistatic agents; polymethyl methacrylate, polystyrene, methacrylic acid-methacrylate copolymer, colloidal silicon oxide and the like as matting agents; latices consisting of copolymers of acrylic esters, methacrylic esters with other monomers having ethylene groups, and the like as film property improvers. Developing nuclei for silver halide complexes suitable for accelerating the formation of silver-containing diffusion transfer images may be contained in the image receiving layer for the diffusion transfer process of the present invention. Examples of the development nuclei include sulfides of noble metals such as silver, gold, platinum, palladium and the like; sulfides of heavy metals such as antimony, bismuth, cobalt, nickel, zinc and the like; fogged silver halides and the like. Colloidal noble metal sulfides are particularly preferred. Furthermore, additives such as fogging agents, sensitizing dyes may be contained in the direct positive silver halide emulsions of the present invention.

A coating layer consisting of a hydrophilic colloidal layer called a back coat layer may be provided on the back side of the photographic material, i.e. the support surface on which there is not provided photographic constitution layers, mostly silver halide photographic constitution layers, for the purpose of giving anticurl, antistatic, antitack, antislip properties and the like. Binders or protective colloids, hardeners, antistatic agents, surfactants, matting agents, latices and the like as described above in the present specification may be contained in the back coat layer. The pH of the back coat layer is desirably 9 or below, preferably 7.0 or below. For carrying out the present invention, the photographic constitution layers are advantageously formed on the support generally by the dip, meniscus, air knife, slide hopper or extrusion bar, or curtain flow method, combination thereof and the like.

The silver halide photographic materials in the present invention are subjected to processings such as exposure, development, stopping, fixing, bleaching, stabilization and the like, as described in "Photographic Photosensitive Materials and Handling Methods" (authored by Goro Miyamoto, Kyoritsu Shuppan Co., Ltd., Photographic Technology 2), according to the kinds, uses, purposes and the like of the materials. For example, after the exposure, the general black and white silver halide photographic material is developed with a solution containing at least a silver halide developing agent and an alkali agent, but in some cases, an active alkali solution containing no or substantially no silver halide developing agent may be used. The developed silver image is fixed and stabilized with an acidic solution containing at least a fixing agent such as sodium thiosulfate or sodium thiocyanate. Typical processing solution used for developing and processing photographic materials for the diffusion transfer process consist of at least a silver halide complexing agent such as a thiosulfate, an alkali agent, a preservative such as a sulfite, and a silver halide developing agents, but an active solution containing no or substantially no developing agent may be used in some cases. After the exposure, the silver halide color photographic material is generally colored and developed with an active alkali bath containing or substantially not containing color developing agent.

Examples will be described below for explaining the present invention more specifically.

EXAMPLE 1

A mixed stock of 50 parts by weight of hard wood bleached kraft pulp with 50 parts by weight of soft wood bleached sulfite pulp was beaten to a Canadian standard freeness of 310 ml, and formed into a sheet of basis weight 150 g/m² by using the following composition:

| | Parts by weight |
|---|---|
| Pulp | 100 |
| Cationic starch | 2 |
| Anionic polyacrylamide resin | 0.5 |
| Sodium stearate | 0.5 |
| Aluminum sulfate | A quantity necessary for adjusting pH to 4.5 |
| Emulsified alkylketone dimer (as ketene dimer) | 0.4 |
| Polyamide polyamine epichlorohydrin resin | 0.4 |

The resulting wet paper was dried on a hot plate at 110° C.

The resulting paper was then impregnated with an impregnating solution having the following recipe at a weight of 30 g/m², and dried in a thermostatic hot air dryer at 110° C.

| | Parts by weight |
|---|---|
| Gelatin | 3 |
| Diaminostilbene disulfonate fluorescent brightening agent | 0.05 |
| Blue dye | 0.002 |
| Citric acid | 0.2 |
| Sodium p-toluenesulfinate | The quantity changed as shown in Table 1. |
| Water | A quantity to make the total 100 |

The resulting impregnated and dried base paper was supercalendered at a linear pressure of 90 kg/cm, and both sides thereof were subjected to the corona discharge. The back side of the paper was then coated with a 1:1 mixture of high-density polyethylene (density 0.96 g/cm³, melt index 5) with low-density polyethylene (density 0.92 g/cm³, melt index 5) at a resin temperature of 330° C. with a melt extruding coater to give a coating film of thickness 20μ. The surface was then coated with low-density polyethylene [density 0.92 g/cm³, melt index 5 (The density and melt index are those measured before adding the undermentioned pigment)] containing 12% of anatase-type titanium oxide at a resin temperature of 330° C. to give a coating film of thickness of 20μ.

The surface of the polyethylene coating film containing the titanium oxide was then subjected to the corona discharge.

A silver halide photographic emulsion, having a halogen composition AgBr/AgCl=45/55 and an average particle diameter of 0.6μ, substantially consisting of a crystal face of [1, 0, 0] was prepared by forming and dispersing 19.2 g of silver halide particles from silver nitrate in 14.4 g of gelatin in the presence of $6\times10^{-6}$ g of potassium hexachlororhodate (III), and sensitized with sulfur at the highest sensitivity. The silver halide photographic emulsion was then dissolved in 420 g of 8% aqueous solution of gelatin. To the resulting solution were added 6.4 cc of 0.1% solution of a sensitizing dye expressed by the formula [II]

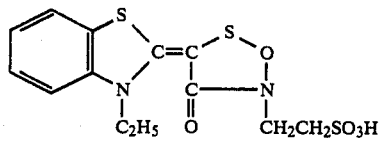

[II]

in N,N-dimethylformamide, 0.48 cc of 1% solution of 1-phenyl-5-mercapto-tetrazole in methanol and 0.48 cc of 1% solution of 1-benzoylamino-2-phenyl-5-mercaptotriazole in methanol, and further 10 cc of 10% sodium docecylbenzenesulfonate solution, 20 cc of 1% aqueous solution of a substituted diaminostilbenedisulfonate salt fluorescent brightening agent and 16 cc of 12% aqueous solution of formalin. Furthermore, 3.2 g of methylhydroquinone as a silver halide developer was dissolved in isopropyl alcohol and added to the mixture. An emulsion containing no silver halide developer was prepared separately. The emulsions were then adjusted by a pH adjuster to pH 4.6, and water was added to adjust the total weight to 600 g. The above-mentioned polyethylene-coated paper was then coated with the resulting emulsion at a coating weight of 75 g/m² (wet).

In 300 cc of water was dissolved 30 g of gelatin, and 6.8 cc of 10% sodium dodecylbenzenesulfate solution and 18 cc of 12% aqueous solution of formalin were added to the solution. Water was then added to adjust the total weight to 400 g. The resulting solution was then applied to the emulsion layer on the polyethylene-coated paper at a coating weight of 40 g/m² (wet) to form a protective layer thereof.

The coated and dried paper samples were stored at normal temperature and humidity for 2 days and then 50° C. and 80% for 6 days. The stored paper samples were developed with a 1:3 diluted solution of D-72 developer at 20° C. for 90 sec and stopped, fixed, washed with water and dried. The whiteness of the right and the back sides of the dried photographic paper was examined by a color-difference meter. The stored paper sample was exposed for the sensitometry for 0.1 sec and developed. The photographic properties were measured to examine the shelf life.

The results obtained are shown in Table 1.

TABLE 1

| | Content of sodium p-toluenesulfinate in said impregnating solution (Parts by weight) | Presence of developer in emulsion | ΔL Right side | ΔL Back side | Δb Right side | Δb Back side | Density of unexposed areas in sample at 50° C. 80% RH |
|---|---|---|---|---|---|---|---|
| Comparative test | (1) None | No | −9.1 | Within −0.1 | Within ±0.05 | Within ±0.05 | 0.09 |
| | (2) None | Yes | −11.9 | −1.3 | +4.55 | +3.5 | 0.14 |
| Test of the present invention | (1) 0.2 | Yes | −9.9 | −0.5 | +3.6 | +2.3 | 0.12 |
| | (2) 0.8 | Yes | −9.6 | Within −0.1 | +3.0 | +1.1 | 0.11 |
| | (3) 3.0 | Yes | −9.4 | Within | +1.5 | +0.8 | 0.10 |

TABLE 1-continued

| Content of sodium p-toluenesulfinate in said impregnating solution (Parts by weight) | Presence of developer in emulsion | ΔL Right side | ΔL Back side | Δb Right side | Δb Back side | Density of unexposed areas in sample at 50° C. 80% RH |
|---|---|---|---|---|---|---|
| | | | −0.1 | | | |

(Notes)
ΔL = L(50° C., 80% RH, 6 days) − L (normal temperature and humidity, 2 days)
Δb = b(50° C., 80% RH, 6 days) − b (normal temperature and humidity, 2 days)

Physical property values L and b are obtained by the measurement with an ND-101DC type color-difference meter manufactured by Japan Electron Optics Laboratory Co., Ltd. According to the method for indicating the color difference provided in JIS Z 8730 with three values L, a and b. L represents the lightness, and a larger value indicates a higher lightness, a represents the redness, and a larger value indicates stronger redness with a negative value representing green color. b represents yellowness, and a larger value indicates stronger yellowness with a negative value representing blueness.

As can be seen from Table 1, the comparative tests ① and ② show the problems of reduction in ΔL values (reduction in lightness) and increase in Δb values (yellowing) of the right and the back sides by the presence of the developer. In contrast, tests of the present invention ①, ② and ③ show remarkable improvements in ΔL and Δb values. A great reduction in ΔL value in Table 1, is due to the fogging during the storage at a high humidity. As a result of the sensitometry, the photographic materials of this invention cause no photographic problem. Further the concentration difference between comparative test ② and Tests of the present invention ①, ② and ③ is magnified to 0.05 or more by increasing the density of unexposed areas due to the enhanced development at 30° C. for 3 min. This means that the photographic materials in this invention show effectiveness not only for the prevention of discoloration of the base paper but also for the photographic properties.

EXAMPLE 2

Procedures similar to those in Example 1 were followed except that sodium benzenesulfinate or sodium dodecylsulfinate were used instead of sodium p-toluenesulfinate in Example 1. The results obtained were the same as those in the case of sodium p-toluenesulfinate.

Example 3

Procedures similar to those in Example 1 were followed except that a mixture of 3.2 g of methylhydroquinone with 0.1 g of 1-phenyl-3-pyrazolidone; 3.2 g of hydroquinone; 3.2 g of 2,5-di-tert-butylhydroquinone; 3.2 g of hydroquinone monobenzoate instead of 3.2 g of methylhydroquinone in Example 1 as the silver halide developing agent were dissolved in suitable solvents respectively, and the resulting solutions were added to the emulsions. The results obtained were the same as those in the case of methylhydroquinone.

EXAMPLE 4

The polyethylene resin-coated paper prepared in the same manner as in Example 1 was used.

To 1 cc of 10% aqueous solution of gelatin were added 0.6 cc of 10% aqueous solution of sodium sulfide and 0.55 cc of 10% aqueous solution of cobalt (II) nitrate. The dispersion of cobalt (II) sulfide nuclei previously prepared at 45° C. was added to 480 g of 5% aqueous solution of gelatin. To the resulting mixture were added 60 g of 10% aqueous solution of carboxymethyl cellulose, 40 cc of 12% aqueous solution of formalin and 10 cc of 5% aqueous solution of saponin. 10 g of hydroquinone was then dissolved in an adequate amount of methanol and added to the mixture. Water was then added to adjust the total weight to 1000 g. The resulting solution for an image receiving layer of the diffusion transfer process was then applied to the above mentioned poly-ethylene-coated paper at a coating weight (wet) of 50 g/m$^2$ and dried to prepare an image receiving material for the diffusion transfer process.

The paper samples thus obtained were stored at 50° C. and 80% RH, and the right and the back sides of the image receiving materials were observed. The image receiving material of the present invention wherein the polyethylene-coated base paper was treated with sodium p-toluenesulfinate had good whiteness in both the right and the back sides. On the other hand, the right and the back sides of the image receiving material for comparison wherein the base paper was untreated turned yellowish red remarkably.

What is claimed is:

1. A photographic material comprising a support and, provided thereon, a photographic constitution layer or layers at least one of which contains at least one silver halide developer characterized in that said support is obtained by coating a film-forming resin on base paper surface-treated with at least one compound expressed by the general formula (I):

$$R—SO_2M \quad (I)$$

wherein R represents an alkyl group, substituted alkyl group, aryl group or substituted aryl group; M represents a hydrogen atom, alkali metal atom, alkaline earth metal atom or ammonium, the amount of the compound expressed by the general formula (I) being 50–5000 mg per m$^2$ of the base paper.

2. A photographic material of claim 1, wherein the compound expressed by the general formula is selected from the group consisting of benzenesulfinic acid, p-toluenesulfinic acid, and a salt thereof.

3. A photographic material of claim 1, wherein at least one of photographic constitution layer or layers is a silver halide photographic emulsion layer.

4. A photographic material of claim 3, wherein the layer containing the silver halide developer is at least the silver halide photographic emulsion layer.

5. A photographic material of claim 4, wherein the silver halide developer is selected from the group consisting of a hydroquinone compound, a pyrazolidone compound and a mixture thereof.

6. A photographic material of claim 5, includes a hydroquinone and wherein the hydroquinone compound is selected from the group consisting of hydroquinone, methylhydroquinone, 2,5-di-tert-butylhydroquinone and hydroquinone monobenzoate.

7. A photographic material of claim 5, includes a pyrazolidone and wherein the pyrazolidone compound is 1-phenyl-3-pyrazolidone.

8. A photographic material of claim 5, wherein the silver halide developer is a mixture of methylhydroquinone with 1-phenyl-3-pyrazolidone.

9. A photographic material of claim 1, wherein the film-forming resin is polyethylene.

10. A photographic maerial of claim 1, wherein a back coat layer is provided on the back side thereof.

11. A photographic material of claim 1, which is used as an image receiving material for the diffusion transfer process.

* * * * *